US006526853B2

(12) United States Patent
Jenkins

(10) Patent No.: US 6,526,853 B2
(45) **Date of Patent: *Mar. 4, 2003**

(54) ELECTROMECHANICAL RELEASING TORQUE WRENCH

(76) Inventor: Bradley G. Jenkins, 1812 E. Evergreeen St., Duarte, CA (US) 91010

( * ) Notice: Subject to any disclaimer, the term of this patent is extended or adjusted under 35 U.S.C. 154(b) by 0 days.

This patent is subject to a terminal disclaimer.

(21) Appl. No.: 09/772,351

(22) Filed: Jan. 31, 2001

(65) Prior Publication Data

US 2002/0152849 A1 Oct. 24, 2002

(51) Int. Cl.[7] ..... B25B 23/144
(52) U.S. Cl. ..... 81/479; 81/483
(58) Field of Search ..... 81/467, 469, 473–483; 73/862.21–862.26

(56) References Cited

U.S. PATENT DOCUMENTS 6,119,562 A * 9/2000 Jenkins ..... 81/479
6,276,243 B1 * 8/2001 Jenkins ..... 81/479

* cited by examiner

*Primary Examiner*—D. S. Meislin
(74) *Attorney, Agent, or Firm*—Albert O. Cota

(57) ABSTRACT

An electromechanical releasing torque wrench which includes an electronic controller (50) and transducers (32) or (34) to measure and actuate a release of the wrench with physical, audible and visual signals. In operation, the user sets the desired torque-release-point on the keypad (60) of the electronic controller and then attaches the wrench to a workpiece with the ratchet means which pivotally protrudes from the enclosure (20). The user tightens the workpiece, normally a threaded fastener, and the force sensing means attached to the ratchet (28) produce an analog signal which is applied to the controller. When the release point is reached the controller sends a signal to a solenoid (44) creating linear mechanical motion causing the mechanical advantage locking latch and trigger means to disconnect the ratchet producing a momentary reduction of force felt by the operator and an audible clicking sound as the ratchet strikes the enclosure.

7 Claims, 3 Drawing Sheets

ELECTROMECHANICAL RELEASING TORQUE WRENCH

TECHNICAL FIELD

The invention relates to torque wrenches in general and more particularly to a torque wrench that disengages at a predetermined adjustable value by electronically sensing torque and releasing force using electronically actuated linkage while simultaneously creating and audible clicking sound.

BACKGROUND ART

Previously, many types of torque wrenches have been used to provide an effective means for tightening threaded fasteners to a predetermined value of tension. In the past mechanical wrenches have utilized spring tension to determine the amount of torque applied to tighten a threaded fastener. These wrenches historically employ a mechanism that uses some type of metallic member that is released when the desired torque is obtained, thus striking the housing or other part of the wrench to produce a distinct mechanical release and to produce a distinct sound, such as an audible "click". Further, industry has developed specialty wrenches that include electronic means for measuring the amount of torque applied to a structure in response to the manual application of force independent of the position of the user's hand.

A search of the prior art did not disclose any patents that read directly on the claims of the instant invention, however the following U.S. patents are considered related:

| U.S. Pat. No. | INVENTOR | ISSUED |
|---|---|---|
| 5,741,186 | Tatsuno | 21 Apr. 1998 |
| 5,662,012 | Grabivac | 2 Sep. 1997 |
| 5,643,089 | Hummel | 1 Jul. 1997 |
| 5,156,072 | Muralidharan | 20 Oct. 1992 |
| 5,142,951 | Walton | 1 Sep. 1992 |
| 4,982,612 | Rittmann | 8 Jan. 1991 |
| 4,864,841 | Heyraud | 12 Sep. 1989 |
| Foreign patent Documents | | |
| 3534520 | Germany | 9 Apr. 1987 |
| 2829009 | Germany | 10 Jan. 1980 |
| 2651636 | Germany | 24 May 1978 |
| 2338304 | Germany | 30 Oct. 1975 |
| 0372247 | European Patent | 9 Nov. 1989 |
| 0360894 | European Patent | 9 Sep. 1988 |

Tatsuno in U.S. Pat. No. 5,741,186 teaches an impulse torque generator for a hydraulic impulse torque wrench. The generator includes a liner driven by a rotor. The liner has an inner cavity having two pairs of sealing surfaces around its inner peripheral surface. A main shaft extends through the liner having projections and driving blades that generate the torque on the shaft by abutting the projections.

Grabivac discloses in U.S. Pat. No. 5,662,012 an adjustable click-type torque wrench. Adjustment is accomplished by a carrier nut engaging the rear end of a lever arm that is contiguous with a spring.

U.S. Pat. No. 5,643,089, issued to Hummel, discloses a non-jarring design that resets the wrench without jarring the output shaft after it delivers the preset maximum torque. The wrench utilizes interchangeable output shafts such that a variety of different drive tips may be employed with the same handle. The cam surfaces of the output shafts have unique surfaces to accommodate varying torque value.

Muralidharan in U.S. Pat. No. 5,156,072 discloses a mechanical torque wrench that employs a plurality of levers. A first lever is journalled to an output shaft for rotation and the remaining levers are pivotally secured to a housing adjacent with their ends along the longitudinal direction of the wrench handle. The torque value is adjusted by changing the force to be overcome by the lever to the pivot.

U.S. Pat. No. 5,142,951 issued to Walton discloses a torque wrench that utilizes a hydraulic piston-cylinder assembly, which rotates a member around an axis located perpendicular to the wrench body. A reaction member is attached to the body and is pivoted relative to the axis between different positions extending angularity out from the body.

Rittmann in U.S. Pat. No. 4,982,612 teaches a torque measuring wrench using a deflection beam, with four strain gauges mounted thereon. One gauge is positioned on a reduced cross-sectional area and the other is closer to the ratchet head. A tubular handle encloses a battery-powered control circuit having indicating means, which provides measurements that are independent of the position along the handle at which the force is applied.

U.S. Pat. No. 4,864,841 issued to Heyraud discloses an electronic wrench that employs two strain gauges that are placed on either side of a crosswise plane. An electronic circuit determines and stores a constant factor for calibration, and the value of torque is measured by the strain gauges and displayed.

For background purposes and as indicative of the art to which the invention is related reference may be made to the remaining cited foreign patents.

DISCLOSURE OF THE INVENTION

Currently there is great demand for wrenches that measure the amount of torque applied to a threaded fastener. The ultimate strength of a fastener cannot be achieved without controlling the amount of torque, since too much can easily break the fastener, thereby leaving a stub inside, which creates difficulty in its removal, particularly if the fastener, such as a capscrew or bolt, is attached to a threaded hole. In the past mechanical tools have been used, and, due to wide spread distribution have become a commonplace and relatively inexpensive. There are numerous drawbacks however, as their accuracy is only passable in some circumstances, as it is affected by ambient conditions, deterioration or relaxation of springs due to time also mechanical wear on moving parts. Scales are permanently marked therefore if some degree of improved accuracy is desired it is necessary to calibrate the tool with a separate gauge or fixture.

The most popular type of torque wrench is called a micrometer or clicking torque wrench and has a hollow arm which includes a spring and pawl mechanism for setting torque. Within the hollow arm, the pawl is forced against one end of a bar that is connected to a drive end. The bar and a drive head are pinned to the hollow arm and rotate as torque is applied. The pawl is released when the force applied by the bar increases beyond a set value established by the operator. When released, the bar hits the inside of the arm, thus producing a sound and a distinct feel by a user. The torque value or release point is changed by rotating the handle, which moves on threads for setting. Additionally, values are permanently stamped or imprinted on a scale that is located on an outer surface of the hollow arm.

The accuracy of the wrench is approximately 4% of the rated setting with the calibration process extremely labor intensive. This type of wrench permits a false sense of accuracy as the actual torque applied by the user may be significantly different than the value imprinted on the handle. This results in inaccurate applications of torque since the release point is significantly affected by the temperature, spring rate, mechanical wear that occurs over time, and the rate at which the user applies the torque. None of these factors are compensated for as the scale is permanently imprinted on the handle.

These wrenches also overtorque when the operator continues to apply pressure after release, due to the momentum created by the releasing mechanism. This overtorque may occur without the user even realizing it.

Another well known wrench type is called a "cam-over" wrench wherein a ball bearing or roller is held within a detent. A spring holds the ball within the detent and when the torque on the drive overcomes the spring force on the ball, the ball displaces and the ratchet rotates. This wrench is efficient in that it does not create overtorque however, it has all the same problems as a mechanical wrench which is highly reliant on spring characteristics, wear, calibration difficulties, and it is basically more expensive.

In order to overcome the above difficulties, prior art has developed an electronic or digital torque wrench. This type of wrench uses a plurality of strain gauges which are applied to measure deflection in a solid beam member and provide electrical output signals to determine and display torque value. Such torque values are typically displayed on easily readable digital readout devices. These wrenches are appreciably more accurate (0.5%) and display the torque applied to the fastener. The torque values may be stored in a computer memory and used for traceability. The most significant problem that limits the market of this type of wrench is that it does not physically release or click therefore the user must relay on a visual light or an audible buzzer.

Therefore the primary object of the invention is to provide a torque wrench that uses a combination of electronics for accuracy, and a mechanical release and so called "click" that permits the familiar feel that a user has become accustomed to. This combination which is novel and unique relies on old principles known to those knowledgeable in the industry and current state of the art of miniaturized electronics. Further, the size and shape of the invention is well recognized and acceptable to users.

An important object of the invention is that the wrench not only signals the operator by the feel of the release and audible clicking sound, but also by a buzzers light and visual indication of the actual torque value at the time of release.

Another object of the invention is the durability of the wrench. When compared with other torque wrenches presently available, this wrench has few moving parts that are designed so that wear will not affect the torque accuracy.

Still another object of the invention is the elimination of an overtorque problem of prior art due to momentum after release has occurred. The invention provides a visual display the exact torque at the instant of release. Therefore if the user continues to torque the wrench or if the impact of the pawl within the wrench have any effect on the outcome it is immediately realized and may be easily compensated for.

Yet another object of the invention is the ease of adjustment as the electronics include a switch plate with pressure sensitive pads permitting the user to simply dial in the torque value desired and confirm the setting on the visual display.

A further object of the invention is that the wrench is simple to calibrate and does not require matching or replacing components as does prior art in the all mechanical version.

These and other objects and advantages of the present invention will become apparent from the subsequent detailed description of the preferred and other embodiment also the appended claims, further, taken in conjunction with the accompanying drawing.

BEST MODE FOR CARRYING OUT THE INVENTION

The best mode for carrying out the invention is presented in terms of a preferred embodiment which is shown in FIGS. 1–11. The prior art is shown in FIGS. 12 and 13.

Figure 12:
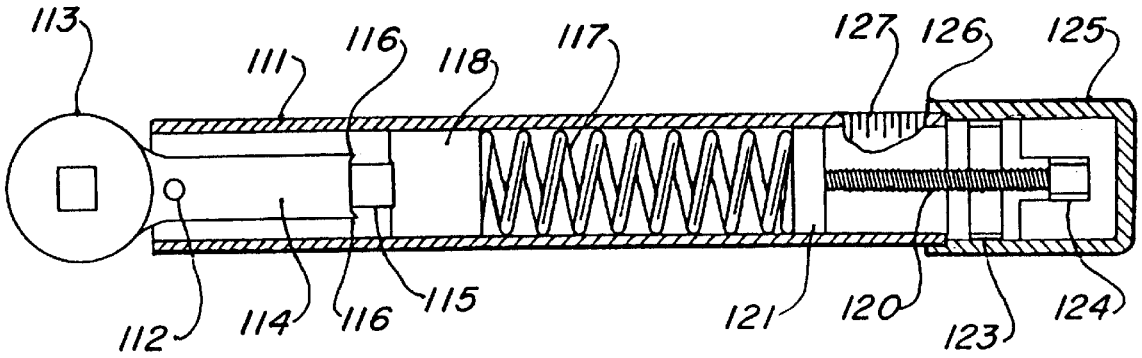
FIG. 12 PRIOR ART
FIG. 12 is a cross sectional view of a prior art micrometer torque wrench prior to release.
Figure 13:
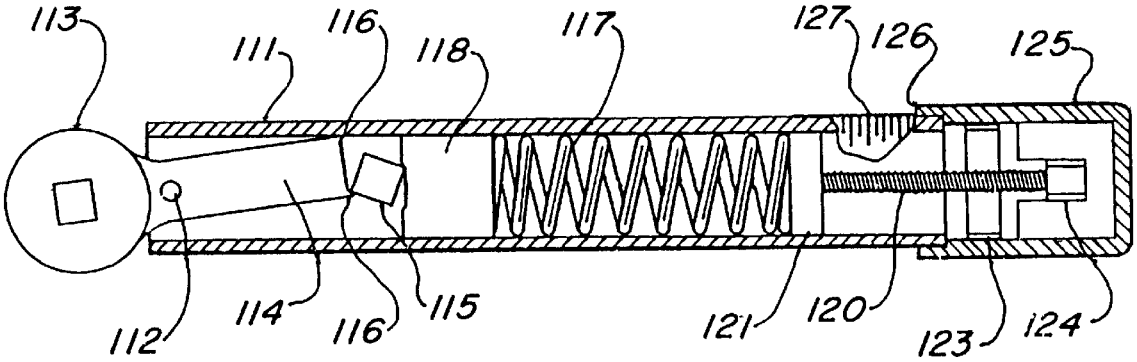
FIG. 13 PRIOR ART
FIG. 13 is a cross sectional view of a prior art micrometer torque wrench after release.

In order to fully understand the desired function of the instant electromechanical releasing torque wrench it may be advantageous to describe the mechanics of a prior art micrometer or so called "clicking" torque wrench, as illustrated in FIGS. 12 and 13, prior to and after release, respectively. This type of torque wrench includes an outer arm 111 which is typically cylindrical in form, although rectangular arms are also utilized. A drive piece 113, which usually includes a ratchet, is pivotally connected to one end of the arm 111 by a pin 112. The drive piece 113 is shaped at one end like a bar 114, which is inserted into a hollow cylindrical interior of the arm 111 and bears against a pawl 115 located within the arm 111. A spring 117 in the hollow cylindrical interior of the arm 111 pushes against a cam 118 which holds the pawl 115 in place against the bottom of the bar 114 between projecting edge 116. The spring 117 may be compressed by rotating a screw 120 to displace a push block 121. The screw 120 moves in threads of a plug 123 which are fixed in position with respect to the arm 111 generally by a press fit or by pins. A handle 125 fits over an end of the screw 120 and causes the screw to rotate with the handle. The handle moves with the screw 120 and has an edge 126 adjacent a scale 127 that is normally stamped into the outer surface of the arm 111. The stamped scale 127 provides markings for adjusting the torque that is applied by the wrench.

It may be seen in FIG. 13 that when torque is applied to the drive piece 113, the drive piece rotates around the pin 112. The pawl 115, however, is held by edges 116 on the bar 114, and holds the bar of the drive piece 113 fixed until the torque overcomes the force applied by the spring 117 and the pawl 115 rotates on the upper surface of the cam 118. When the pawl 115 rotates, the bar 114 of the drive piece 113 is released and move against an interior cylinder wall of the arm 111 with an audible click. This click and the momentary release of force on the drive piece are sensed by the user to indicate that the torque value set on the scale 127 has been reached.

In order to assure that the torque values are accurate, the springs, particularly in the value of the spring constant, the pawl surface dimensions, and the cam surface dimensions must be carefully selected and, accurately manufactured. In addition, the wrench must be initially calibrated so that the torque values are correct at both the lower and upper ends of the scale.

The lower end of the scale is adjusted fairly easily by moving a bottom nut 124 so that the handle moves up and down on the hollow arm until a marked position on the edge 126 of the handle 125 is adjacent the lowest value on the scale, this value is typically twenty percent (20%) of the full scale reading. The lower position is tested against a known torque applied to the drive after each adjustment until the value of the torque is correct at corresponding points of the scale.

The upper end of the scale is much harder to adjust and can be accomplished only after the bottom end has been calibrated. The upper position is tested against a known torque applied to the drive until the value of torque applied matches the setting at the highest point of the scale. If the torque value does not initially match the value on the scale against the mark on the edge 126, the setting is adjusted by replacing the pawl 115 with a pawl which is either thicker or thinner. This requires movement of the drive piece 113 by driving the pin 112 out such that a new pawl may be inserted. The highest reading on the scale is again measured against the torque value anticipated at the upper position. If this is still incorrect, the process must be repeated. It is apparent that obtaining the correct adjustment can be a very labor intensive operation. In some exceptional cases the spring must also be replaced, thus resulting in further labor and expense. Variations in spring constants, surface finish, lubrication and material hardness make it necessary to check each wrench individually for correct pawl thickness.

Having this knowledge of prior art it is obvious to visualize why improvements to this type of wrench would increase its utility.

Referring now to the preferred embodiment of the instant invention, which is illustrated in FIGS. 1–11, the electromechanical torque wrench is comprised of an enclosure 20 that is a hollow round metallic structure and tubular in shape. While this circular outline form is preferred square rectangular, irregular, polygonal, oval etc. may also be used as long as it is sufficiently hollow to encase operable elements inside, further, similar materials may be used however metal is preferred. The enclosure 20 has a first end 22 and a second end 24 with a handle 26 attached upon the second end. The handle 26 is of a resilient material and is well known in the art. The length of the enclosure 20 is determined by the desired capacity of the torque wrench and is governed by the average ability of the user to apply force to a lever arm.

Figure 1:
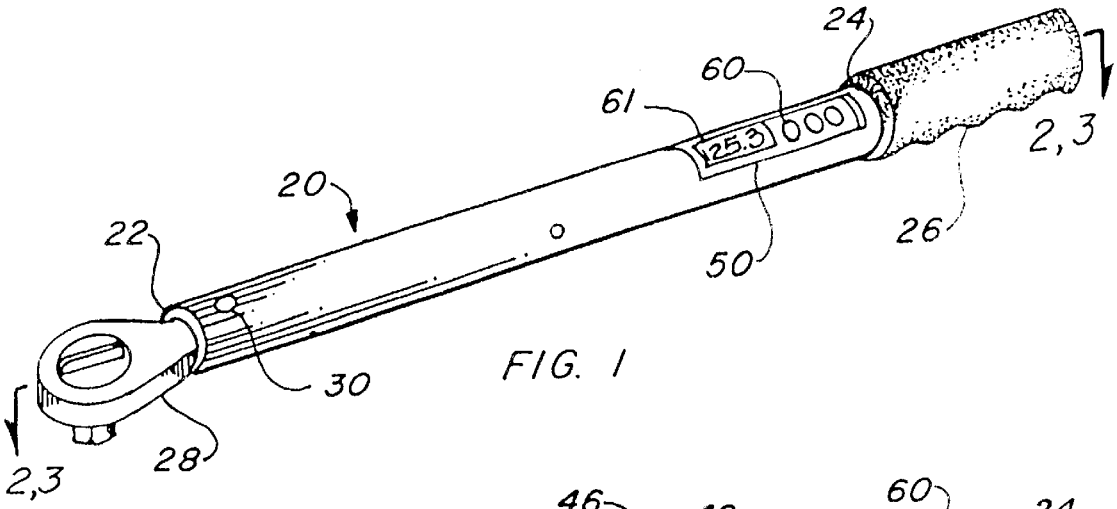
FIG. 1 is a partial isometric view of the preferred embodiment.
Figure 2:
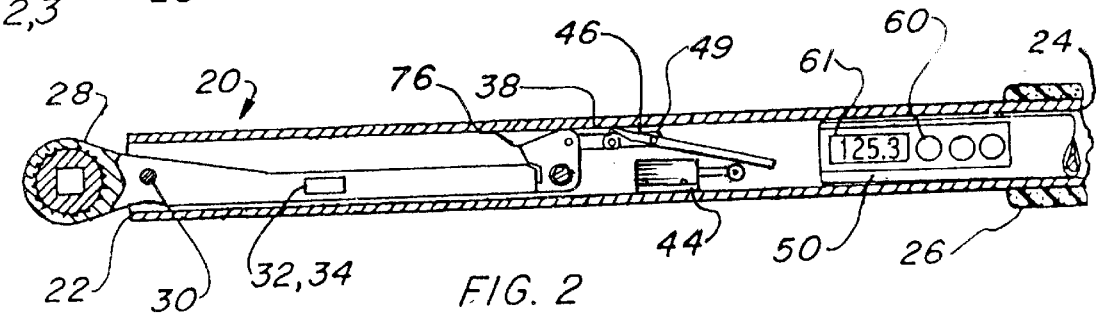
FIG. 2 is a cross sectional view taken along 2—2 of FIG. 1 with the wrench illustrated prior to release.
Figure 3:
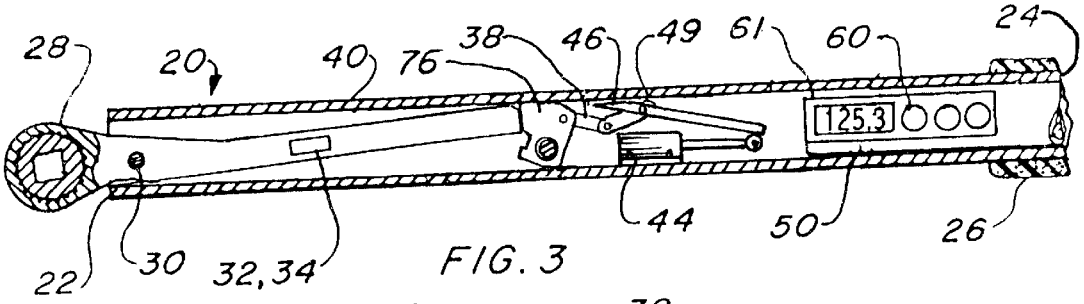
FIG. 3 is a cross sectional view taken along 3—3 of FIG. 1 with the wrench illustrated after release.
Figure 4:
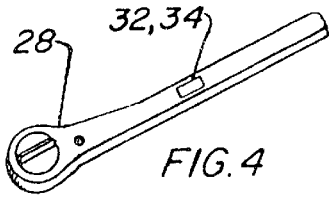
FIG. 4 is a partial isometric view of the square drive ratchet arm completely removed from the invention for clarity.
Figure 5:
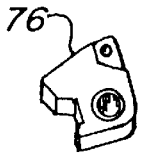
FIG. 5 is a partial isometric view of the holding pawl completely removed from the invention for clarity.
Figure 6:
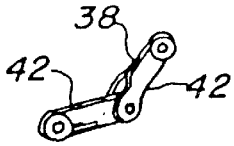
FIG. 6 is a partial isometric view of the toggle linkage completely removed from the invention for clarity.
Figure 7:
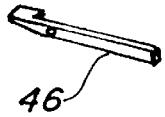
FIG. 7 is a partial isometric view of the solenoid lever arm completely removed from the invention for clarity.

Ratchet means in the form of a square drive ratchet 28 with an extending arm and operable mechanism to reverse direction of the ratchet is disposed within the first end 22 of the enclosure 20, as shown in FIGS. 1–3. The square drive ratchet 28 is well known in the industry is obviously used for attachment and rotation of a threaded fastener workpiece such as a nut, bolt, hex capscrew etc.

Ratchet pivot means in the form of a pivot pin 30 that penetrates through both the enclosure first end 22 and the square drive ratchet 28 permits the ratchet to swivel circuitously within boundaries of the enclosure 20. This limited rotational movement is illustrated in FIGS. 2 and 3, wherein FIG. 2 depicts the wrench prior to release and FIG. 3 shows the wrench after it has released, thus depicting the relative movement that has been allowed within boundaries created by the shape of the enclosure 20.

Force sensing means in the form of either a strain gauge transducer 32 or a force cell transducer 34 is permanently attached, with epoxy or the like, onto the square drive ratchet 28 and its function is to convert physical torque value energy into an analog electronic signal. Both transducers are similar in function and are illustrated only as a rectangle in the drawings since they are well known, commonly available and in present use.

Locking latch means are in the form of a holding pawl 76 and toggle linkage 38 with the holding pawl 76 configured to pivot within the enclosure 20 and a first side abut against the extended end of the square drive ratchet's arm. The ratchet arm 28 is held in a fixed rigid position by the interface of the square end of the arm 28 engaging a notch in the pawl 76 until a predetermined amount of torque is applied to the wrench. The toggle linkage 38 consists of a pair of pivoted toggle arms 42 attached together with one end affixed rotatably to a second side of the holding pawl 76 and the other end pivotally connected to the enclosure 20. The arms 42 are in biased alignment maintaining the ratchet 28 in a fixed rigid position within the notch of the holding pawl 76 until a predetermined amount to torque is applied to the wrench where the alignment is disrupted permitting the ratchet arm 28 to rotate from its position in the notch of the pawl 76.

Figure 8:
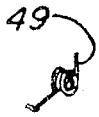
FIG. 8 is a partial isometric view of the reset spring completely removed from the invention for clarity.
Figure 9:
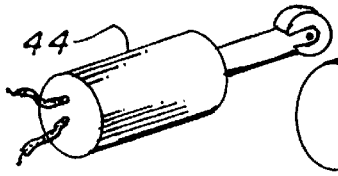
FIG. 9 is a partial isometric view of the electronic magnetic solenoid completely removed from the invention for clarity.

Electromechanical actuated trigger means is in the form of an electromagnetic solenoid 44 with a bobbin and a plunger having a roller on its end. The plunger produces a linear motion or action when the bobbin is supplied with an electrical current creating an electromagnetic field. The electromagnetic field forces the plunger to be propelled, by reversed magnetic polarity, in a longitudinal direction. A spring loaded solenoid lever arm 46 is used to support the toggle arms 42 in parallel alignment disallowing movement of the ratchet 28 until the solenoid arm 46 is thrust outwardly by the solenoid 44 upon which one end is engaged by the roller. FIGS. 2 and 3 illustrate this relationship, with FIG. 2 showing the solenoid arm 46 above the toggle arms 42. When the solenoid 44 is energized, as depicted in FIG. 3, the toggle arms 42 are pressed from above and collapse downward from their biased position. This action releases the ratchet 28 from an indentation in the holding pawl 76 striking the inside of the enclosure 20 due to the momentum created by the operator applying torque to the wrench. The impact of the ratchet 28 creates the desired audible clicking sound that is indeed familiar to the user. When the wrench is released from the physical torque and the solenoid 44 is deenergized the solenoid arm 46 is raised upward on the end contiguous with the toggle arms 42 by a torsion spring 49, as shown in FIG. 8, resetting the trigger means. It should also be noted that the electromechanical actuated trigger means could also be in the form of an electromagnetic linear actuator that operates with an electric motor, a gear set and a mechanical screw, which produces linear motion or action when supplied with an electrical current. Additionally, the trigger means can also be actuated by a pneumatic device that is activated by an air supply.

Figure 10:
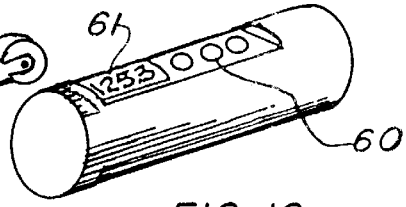
FIG. 10 is a partial isometric view of the electronic controller completely removed from the invention for clarity.
Figure 11:
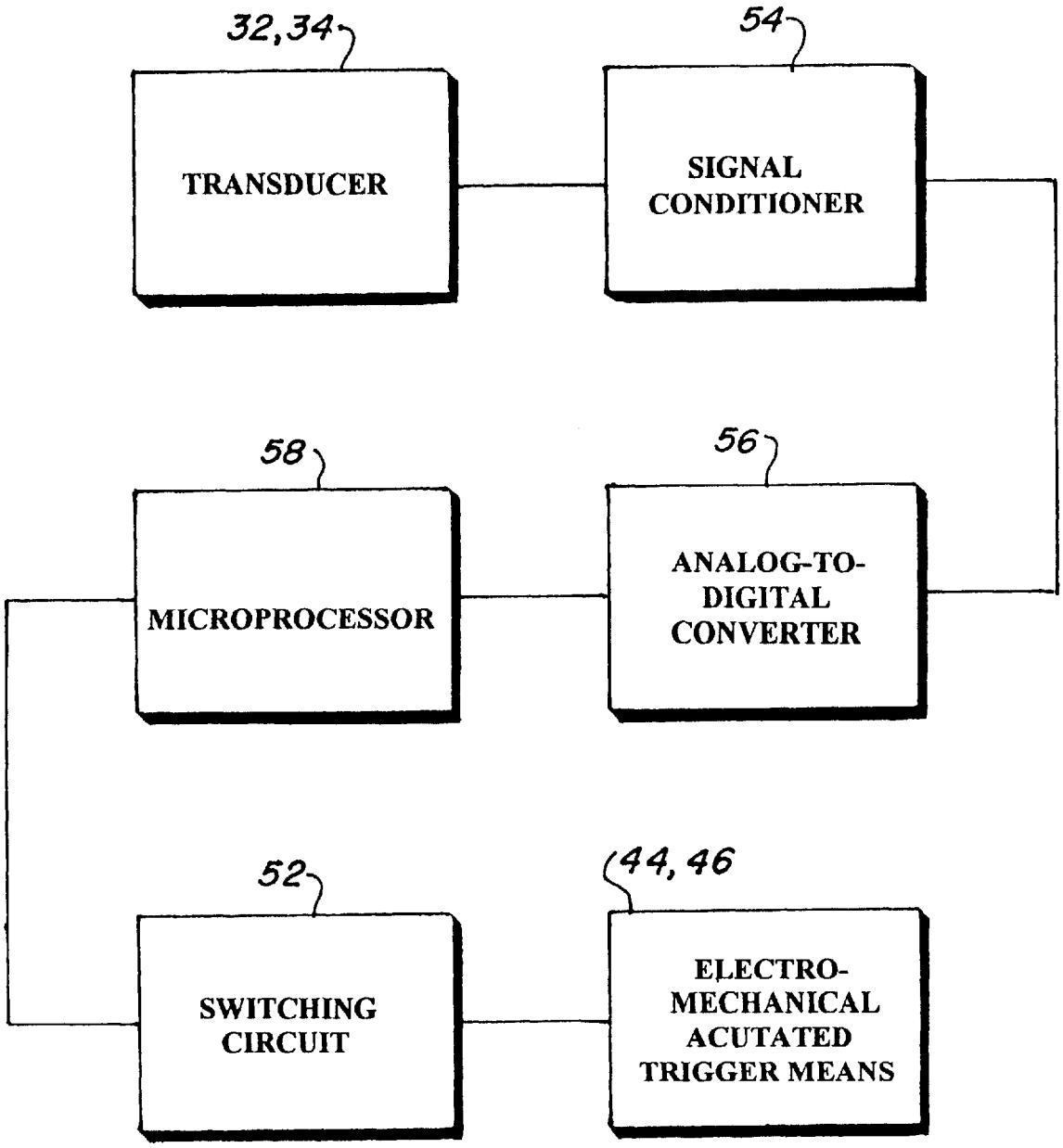
FIG. 11 is a block diagram of the interrelated function of the electronic controller.

An electronic controller 50, as shown in block diagram in FIG. 11 and separated from its mechanical enclosure in FIG. 10, amplifies and conditions a signal from the force sensing means. The force sensing means can consist of either a strain gauge 32 or a force cell transducer 34, and utilizes a switching circuit 52 to control the solenoid 44. The controller 50 includes a signal conditioner 54 that receives, conditions and amplifies the analog signal from the strain gauge 32 or transducer 34. An analog-to-digital converter 56, integral with the controller, converts the conditioned and amplified analog signal into a equivalent digital signal. An electronic controller such as a microprocessor 58 is included that has the ability to enter a torque-release set point corresponding to the torque-release value required by the user. The microprocessor receives and compares the digital signal with the torque-release set point such that when the digital signal and torque-release point are equal, a wrench release signal is produced and applied to the switching circuit 52. The wrench release signal energizes the trigger means and releases the ratchet means which results in a momentary reduction in force felt by the operator and the production of an audible clicking sound. The strain gauge 32 typically utilizes a wheatstone-bridge, which functions as a strain gauge circuit and the means for entering a torque-release set point constitutes a keypad 60. A digital readout 61, preferably comprised of an LCD readout, is included to indicate the torque-release value set point and the absolute value at the point of release. Memory in the microprocessor 58 may store and indicate former values, also, an annunciator and light may be provided to indicate audibly and visually that the release point has been achieved.

To operate the torque wrench, the user manually sets the desired torque-release-point on the keypad 60 of the electronic controller 50 and then attaches the wrench to the workpiece with the ratchet means, which pivotally protrudes from the enclosure 20. The user tightens the workpiece threaded fastener, and the force sensing means attached to the ratchet 28, produces an analog signal to the controller. When the release point is reached, the controller 50 sends a signal to the selenoid 44, thus creating linear motion which causes the locking latch and trigger means to disconnect the ratchet, thereby producing a momentary reduction in force felt by the operator and an audible clicking sound when the ratchet 28 strikes the enclosure.

While the invention has been described in complete detail and pictorially shown in the accompanying drawings it is not to be limited to such details, since many changes and modifications may be made in the invention without departing from the spirit and scope thereof. Hence, it is described to cover any and all modifications and forms which may come within the language and scope of the appended claims.

What is claimed is:

1. An electromechanical releasing torque wrench comprising:

a) an elongated, hollow metallic enclosure having a rectangular shape with a first end and a second end with a handle disposed upon the second end, b) ratchet means disposed within the enclosure with the first end of the enclosure for attachment and rotation of a threaded fastener workpiece, c) ratchet pivot means proximately adjoining the enclosure first end, allowing limited swiveling of the ratchet means within the enclosure, d) force sensing means contiguously engaging said ratchet means converting physical torque value energy into an analog electronic signal, e) locking latch means having a mechanical advantage, abutting and retaining said ratchet means in a fixed rigid position until a predetermined amount of torque is applied to the wrench, said mechanical advantage reducing level of applied torque, f) electromechanical actuated trigger means having mechanical motion and interfacing with the locking latch means such that when a predetermined amount of torque is manually applied to the wrench both the locking latch and ratchet means are released by movement of the trigger means using the mechanical advantage of the locking latch means, simultaneously producing a momentary reduction in force felt by the operator and an audible clicking sound as the ratchet means strikes the enclosure, and g) an electronic controller amplifying and conditioning a signal from the force sensing means and switching a circuit to control the trigger means.

2. An electromechanical releasing torque wrench comprising:

a) an elongated, enclosure having a first end and a second end with a handle disposed upon the second end, b) ratchet means disposed within the enclosure with the first end of the enclosure for attachment and rotation of a threaded fastener workpiece, c) ratchet pivot means proximately adjoining the enclosure first end, allowing limited swiveling of the ratchet means within the enclosure, d) force sensing means contiguously engaging said ratchet means converting physical torque value energy into an analog electronic signal, e) locking latch means having a mechanical advantage, abutting and retaining said ratchet means in a fixed rigid position until a predetermined amount of torque is applied to the wrench, said mechanical advantage reducing level of applied torque, f) electromechanical actuated trigger means having mechanical motion and interfacing with the locking latch means such that when a predetermined amount of torque is manually applied to the wrench both the locking latch and ratchet means are released by movement of the trigger means using the mechanical advantage of the locking latch means, simultaneously producing a momentary reduction in force felt by the operator and an audible clicking sound as the ratchet means strikes the enclosure, wherein said trigger means further comprises an electromagnetic solenoid having a bobbin and a plunger having a roller on its end, with the plunger producing a linear action when the bobbin is supplied with an electrical current creating an electromagnetic field forcing the plunger to be propelled in a longitudinal direction, and g) an electronic controller amplifying and conditioning a signal from the force sensing means and switching a circuit to control the trigger means.

3. An electromechanical releasing torque wrench comprising:

a) an elongated, enclosure having a first end and a second end with a handle disposed upon the second end, b) ratchet means disposed within the enclosure with the first end of the enclosure for attachment and rotation of a threaded fastener workpiece, c) ratchet pivot means proximately adjoining the enclosure first end, allowing limited swiveling of the ratchet means within the enclosure, d) force sensing means contiguously engaging said ratchet means converting physical torque value energy into an analog electronic signal, e) locking latch means having a mechanical advantage, abutting and retaining said ratchet means in a fixed rigid position until a predetermined amount of torque is applied to the wrench, said mechanical advantage reducing level of applied torque, f) electromechanical actuated trigger means having mechanical motion and interfacing with the locking latch means such that when a predetermined amount of torque is manually applied to the wrench both the locking latch and ratchet means are released by movement of the trigger means using the mechanical advantage of the locking latch means, simultaneously producing a momentary reduction in force felt by the operator and an audible clicking sound as the ratchet means strikes the enclosure, and g) an electronic controller comprising:

(1) a transducer which converts an applied physical torque value into an equivalent analog signal, (2) a signal conditioner which receives, conditions and amplifies the analog signal, (3) an analog-to-digital converter which converts the conditioned and amplified analog signal into an equivalent digital signal, (4) a microprocessor having means for:

(a) entering a torque-release set point corresponding to the torque-release value required by a user, and (b) receiving and comparing the digital signal with the torque-release set point, wherein when the digital signal and torque-release point are equal, a wrench release signal is produced by said microprocessor, and (5) a switching circuit that is activated by the wrench release-signal, whereupon a trigger signal is produced that energizes the electromechanical actuated trigger means on said wrench releasing the ratchet means which also produces an audible clicking sound.

4. The torque wrench as recited in claim 3 wherein said transducer comprises a wheatstone-bridge strain gauge circuit.

5. The torque wrench as recited in claim 3 wherein said means for entering a torque-release set point comprises a keypad.

6. An electromechanical releasing torque wrench comprising:

a) an elongated enclosure having a first end and a second end with a handle disposed upon the second end, b) ratchet means disposed within the enclosure with the first end of the enclosure for attachment and rotation of a threaded fastener workpiece, c) ratchet pivot means proximately adjoining the enclosure first end, allowing limited swiveling of the ratchet means within the enclosure, d) force sensing means contiguously engaging said ratchet means converting physical torque value energy into an analog electronic signal, e) locking latch means having a mechanical advantage, abutting and retaining said ratchet means in a fixed rigid position until a predetermined amount of torque is applied to the wrench, said mechanical advantage reducing level of applied torque, f) electromechanical actuated trigger means having mechanical motion and interfacing with the locking latch means such that when a predetermined amount of torque is manually applied to the wrench both the locking latch and ratchet means are released by movement of the trigger means using the mechanical advantage of the locking latch means, simultaneously producing a momentary reduction in force felt by the operator and an audible clicking sound as the ratchet means strikes the enclosure, wherein said trigger means further comprises a spring loaded solenoid lever arm located above the locking latch means disallowing movement of the ratchet means until the solenoid lever arm is pivoted downwardly by an electromechanical portion of the trigger means thus releasing the ratchet means when a predetermined amount of torque is manually applied to the enclosure, also simultaneously producing a momentary reduction in force felt by the operator and an audible clicking sound when the ratchet strikes the enclosure, and g) an electronic controller amplifying and conditioning a signal from the force sensing means and switching a circuit to control the trigger means.

7. An electromechanical releasing torque wrench comprising:

a) an elongated hollow tubular enclosure having a first end and a second end with a handle disposed upon the second end, b) a square drive ratchet, disposed within with the first end of the enclosure for attachment and rotation of a threaded fastener workpiece, c) ratchet pivot means proximately adjoining the enclosure first end, having a pivot pin through both the enclosure and the ratchet, allowing limited swiveling of the ratchet within the enclosure, d) force sensing means contiguously engaging said ratchet converting physical torque value energy into an analog electronic signal, e) locking latch means defining a holding pawl and a toggle linkage with the holding pawl pivotally disposed within the enclosure contiguous with the ratchet means on a first side of said pawl and the toggle linkage on a second side of said pawl, the toggle linkage constituting a pair of pivoted toggle arms held in parallel alignment by said trigger means maintaining said ratchet means until a predetermined amount of torque is applied to the wrench, f) electromechanical actuated trigger means having mechanical motion, wherein said trigger means further comprises a spring loaded solenoid lever arm located above the locking latch means disallowing movement of the ratchet until the solenoid lever arm is pivoted downwardly by an elector-mechanical portion of the trigger means thus releasing the ratchet when a predetermined amount of torque is manually applied to the enclosure, also simultaneously producing an audible clicking sound when the ratchet strikes the enclosure, and g) an electronic controller amplifying and conditioning a signal from the force sensing means and switching a circuit to control the trigger means.

* * * * *